United States Patent [19]

Richardson

[11] 4,099,628

[45] Jul. 11, 1978

[54] TOWING VEHICLE

[75] Inventor: Roy A. Richardson, Belfast, Tenn.

[73] Assignee: Richardson Industries, Inc., Nashville, Tenn.

[21] Appl. No.: 716,245

[22] Filed: Aug. 20, 1976

[51] Int. Cl.[2] ..... B66C 23/02

[52] U.S. Cl. ..... 212/65; 212/59 R

[58] Field of Search ..... 212/59 R, 55, 8 R, 56, 212/66, 61-65; 214/86 A; 254/139.1

[56] References Cited

U.S. PATENT DOCUMENTS

| | | | |
|---|---|---|---|
| 625,643 | 5/1899 | Coffin | 212/56 |
| 1,448,680 | 3/1923 | Steele | 212/67 |
| 1,583,936 | 5/1926 | Noble | 212/67 |
| 2,625,275 | 1/1953 | Ashton | 212/55 |
| 2,637,447 | 5/1953 | Holmes et al. | 214/86 A |
| 2,700,481 | 1/1955 | Donatelli | 214/86 A |
| 3,326,391 | 6/1967 | Adolfsson | 212/55 |
| 3,335,880 | 8/1967 | Ortiz | 214/86 A |
| 3,355,040 | 11/1967 | Guttridge | 214/75 H |
| 3,888,368 | 6/1975 | Hawkins | 214/86 A |
| 3,961,713 | 6/1976 | Stine | 212/66 |

*Primary Examiner*—Lawrence J. Oresky

*Attorney, Agent, or Firm*—Imirie, Smiley & Guay

[57] ABSTRACT

A towing vehicle which has a frame and a drive train for propulsion of the vehicle along a roadway and which includes a turntable mounted on the frame for rotation about a vertical axis, a boom assembly fixedly attached to the turntable, a telescoping boom mounted on the boom assembly, and a cable winch mounted on the boom assembly and cooperating with pulleys such that the towing cable passes along the underside of the telescoping boom, around a pulley, and upwardly to the winch. The boom assembly is adjustable about a horizontal axis by an assembly which includes a carriage and a slider cooperating with a support cable to adjustably preselect the angular position of the pivotal boom assembly with respect to the turntable. The drive mechanisms for the turntable, the telescoping boom, and the winch are electrically operated independent of the vehicle drive train and are controlled by a control box electrically coupled to the drive motors by a cable connected to the vehicle by means of a self-winding cable reel. A second set of controls is provided in the cab of the vehicle, and limit switches cooperate with the turntable to preclude overtravel.

21 Claims, 12 Drawing Figures

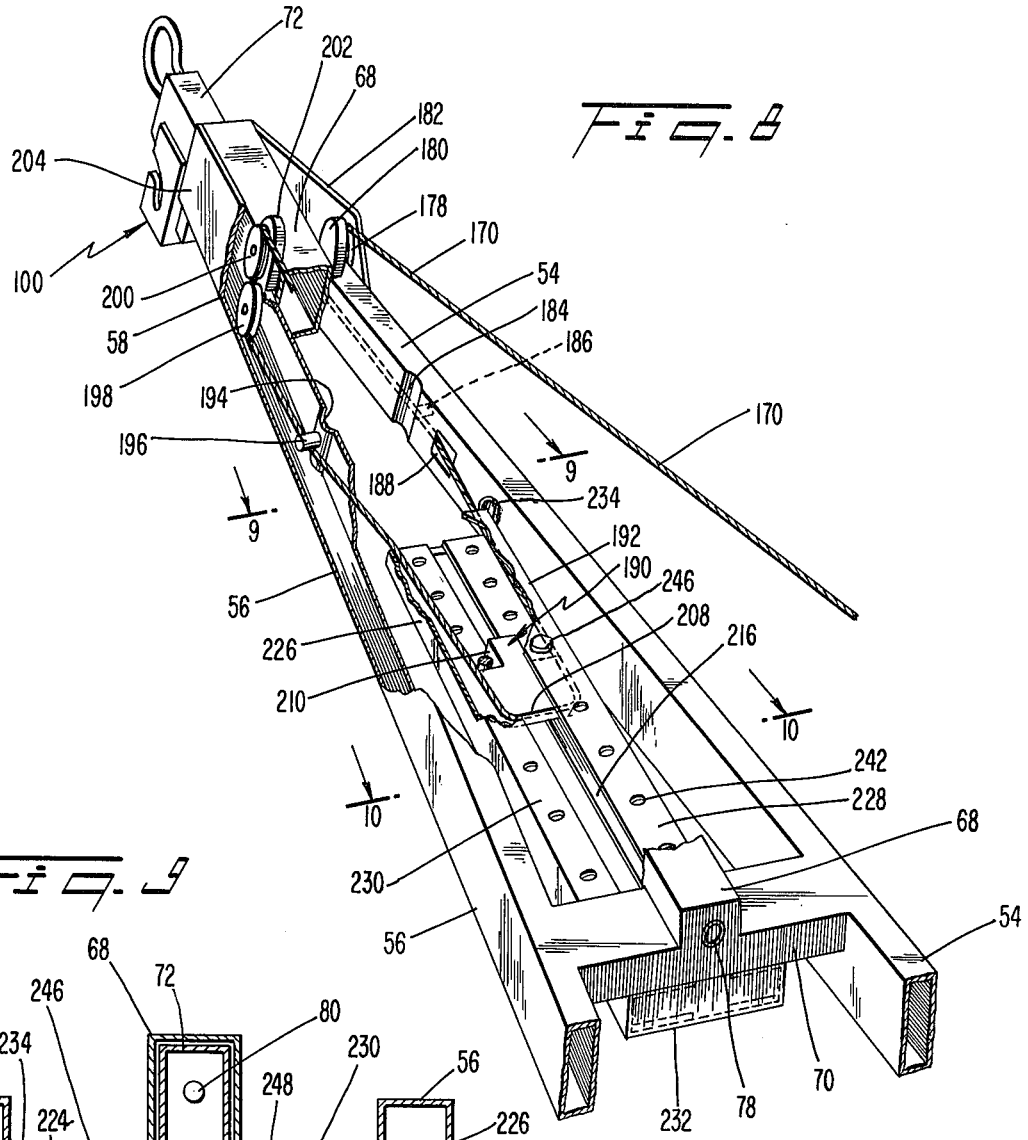
Fig. 8
Fig. 9
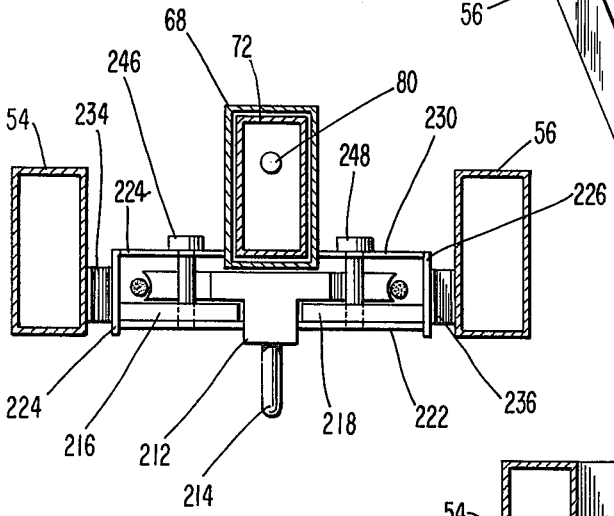
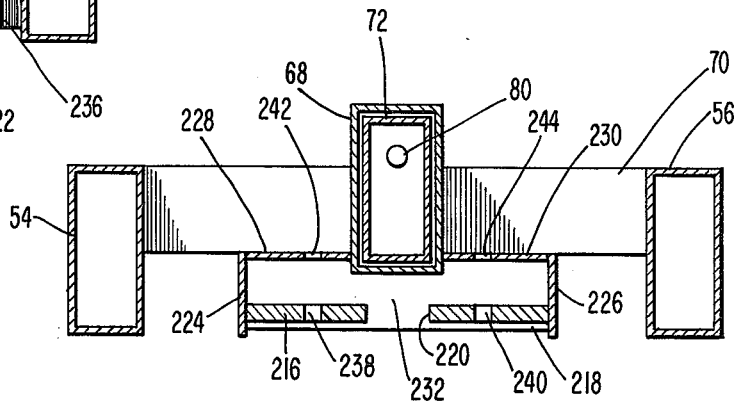
Fig. 10

TOWING VEHICLE

BACKGROUND OF THE INVENTION

1. Field of the Invention:

The present invention relates generally to towing vehicles, and more particularly, to such vehicles equipped with a turntable mounted boom assembly having a telescoping boom and operated by three electrical motors independent of the vehicle drive train.

2. Description of the Prior Art:

In general, most towing vehicle designs in the past have included boom assemblies which are fixedly attached to the vehicle frame. Hydraulic or direct mechanical take-off assemblies are provided for utilizing power generated by the vehicle engine to drive the towing cable winches and other accessories. While such prior art devices have been found to be useful, they have not proven to be entirely satisfactory under all conditions of use since the rigid mounting of the boom assembly on the vehicle frame often requires that the entire vehicle be moved into awkward or dangerous positions in order to, for example, pull a car from a ditch alongside a main highway. In addition, by taking power directly from the vehicle drive train, special transmissions and other equipment are needed causing additional complexity and limiting the engine and transmission options which may be offered to potential purchasers of new towing vehicles.

Many prior art towing vehicles also provide a single set of controls directly mounted to the left or right rear quarter of the vehicle frame. Such direct interconnection is required for practical use of direct mechanical or hydraulic systems, and in many instances is quite convenient, such as when a vehicle is being linked to the towing vehicle for towing purposes. On the other hand, many instances occur where the direct and rigid attachment of winch controls on the vehicle serves as a material disadvantage. In general, whenever the towing cable is to be attached to a vehicle or other object located a fair distance from the towing vehicle, two operators are necessary. One to operate the controls, and the other to attach the cable and supervise progress of the vehicle or object being towed or hoisted. In these circumstances, the manpower required to accomplish a particular task is twice what otherwise would be necessary, and if the needed second operator is not available, considerable delays and inconvenience may result. A further disadvantage in those circumstances requiring two-man operation, is the fact that each man's safety requires full communication between both operators during the hoisting operation. If a heavy vehicle or unusually bulky object is being hoisted, and communications between the two operators are difficult, as for example during a severe storm during the night, it may be difficult for them to fully understand each other causing an extremely unsafe situation.

While the prior art is generally cognizant of the foregoing problems, solutions proposed heretofore have not provided a totally satisfactory and universally usable system. For example, U.S. Pat. No. 2,700,481 discloses a wrecking vehicle in which the hoisting cable can be electrically controlled; however, the system fails to provide for the remote, electrical control of a boom turntable, and the electrical remote control of a telescoping boom. U.S. Pat. No. 2,637,447 is illustrative of another prior art towing vehicle exemplary of such systems wherein power to drive the boom assembly is taken from the vehicle drive train rather than being an independent system.

U.S. Pat. No. 2,559,733 shows a load hoisting device in which the hoisting cable is run along the underside of the boom and the boom is rotatable by means of a hydraulically moved cable slung around a large pulley. Again, this patent fails to provide for the independent, electrical, remote control of boom rotation, telescopic extension or retraction, and cable winch operation and requires the direct control of an operator for all uses.

U.S. Pat. No. 3,638,804 discloses an extendable and retractable boom on a hoisting apparatus, and different types of rotatable boom assembly cranes are shown in U.S. Pat. Nos. 349,582, 837,510, 2,071,905, 2,197,406, 2,557,484, 2,655,269, 3,093,248, 3,285,445, and 3,543,945.

A number of patents also illustrate towing or wrecking vehicles in which a towing cable is run down or along the underside of the boom assembly rather than being passed over the top of the boom assembly. Exemplary of such patents are U.S. Pat. Nos. 1,657,674, 3,158,266, 3,322,396 and 3,335,880.

U.S. Pat. No. 2,730,245 discloses an electronic control system in a hoisting apparatus, and U.S. Pat. No. 3,699,578 illustrates the remote control of a hoisting apparatus by means of a radio transmitter and receiver. Again, these patents fail to disclose a fully integrated, electronically operated hoist system for a towing vehicle having a rotating and telescoping boom fully operable by direct or remote control.

SUMMARY OF THE INVENTION

It is, therefore, an object of the present invention to independently control a rotating boom assembly, a telescoping boom of such assembly, and a cable winch by separate electronic drive motors independent of the towing vehicle drive train.

The present invention has another object in the construction of a towing vehicle having three functions, namely, boom rotation, boom extension and retraction, and cable extension and retraction, in which all three functions may be remotely controlled from any desired position.

A further object of this invention is to construct a towing vehicle capable of performing any hoisting or towing function simply, yet effectively, and exhibiting a high degree of inherent safety by its design.

This invention has yet another object in the remote control of multiple functions of a towing vehicle in a manner which requires minimal operator training.

The present invention is summarized as a towing vehicle having a frame and a drive train for propulsion of the vehicle along a roadway, and includes a turntable mounted on the frame for rotation about a vertical axis; a first electric motor for selectively rotating the turntable about its axis in either direction; a boom assembly attached to the turntable for rotation, the boom assembly including an inverted, generally U-shaped main support having a horizontal member connecting the upper ends of two vertical legs fixedly attached at their lower ends to the turntable, the boom assembly further including a generally V-shaped support frame having first and second arms joined together at one end to form an apex and each pivotally attached at the other end to the turntable adjacent a respective vertical leg of the U-shaped main support for pivotal movement about a horizontal axis, the V-shaped support frame including a support cable to hold the same in a preselected angular position; a telescoping boom mounted to the V-shaped support frame; a second electric motor on the V-shaped support frame for selectively extending and retracting the telescoping boom; an electric cable winch mounted on the horizontal member of the U-shaped main support; a first cable pulley disposed on the turntable under the cable winch and a second cable pulley disposed on the distal end of the telescoping boom for guiding the main cable downwardly from the winch, under the first pulley, along the underside of the V-shaped frame, and over the second pulley; the first and second electric motors and the electric winch being operable independently of the vehicle drive train; and a control network electrically coupled to the motors and the electric winch for controlling the rotatable turntable, the telescoping boom and the cable winch from positions remote from the vehicle.

The present invention is advantageous over the prior art in that it is extremely simple to operate and control, it is easy to manufacture and maintain, it exhibits safety features far above those presently available, and can be used to effectively hoist or tow vehicles or objects from any number of locations or positions near or next to a roadway.

Other objects and advantages of the present invention will become apparent from the following detailed description of the preferred embodiment when taken in conjunction with the accompanying drawings.

BRIEF DESCRIPTION OF THE DRAWINGS

FIG. 8 is a partial perspective view, with parts broken away, of the boom adjusting assembly of the towing vehicle of FIG. 1;

FIG. 9 and 10 are cross sectional views taken along lines 9—9 and 10—10, respectively, of FIG. 8;

DESCRIPTION OF THE PREFERRED EMBODIMENT

Figure 1:
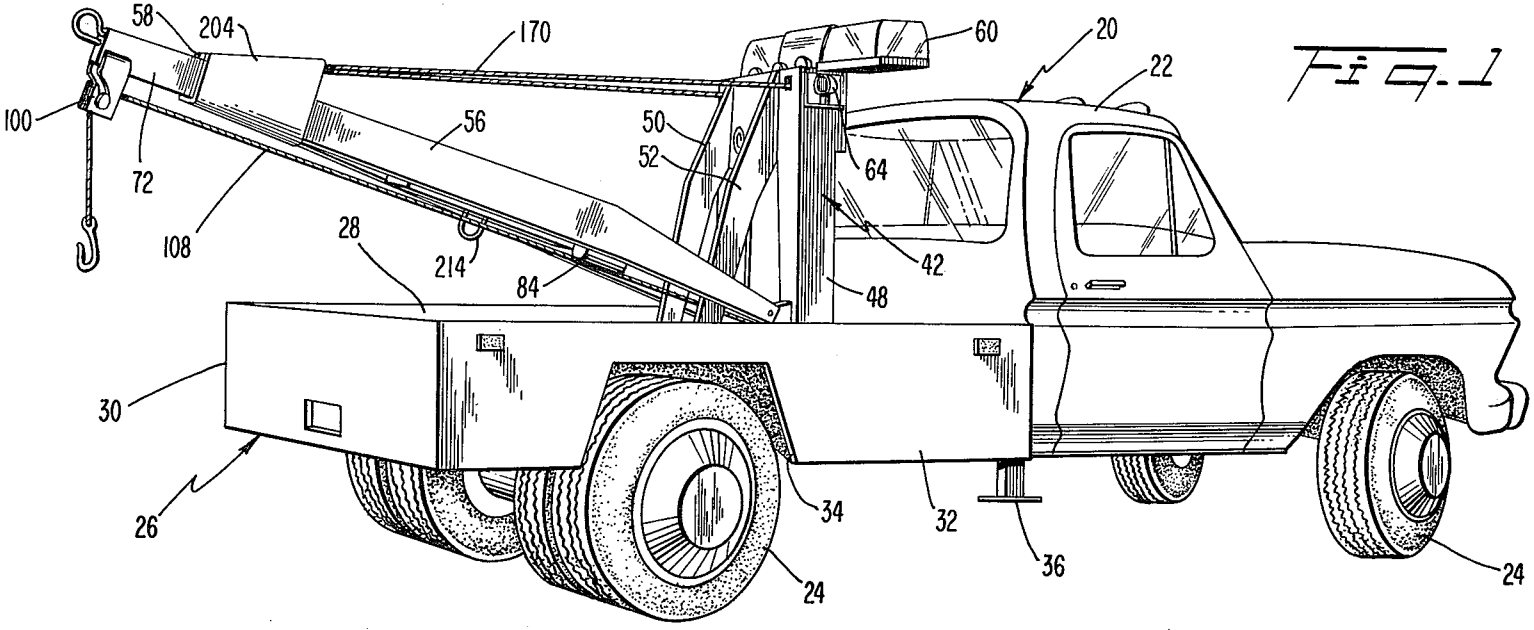
FIG. 1 is a perspective view of a preferred embodiment of a towing vehicle according to the present invention.
Figure 2:
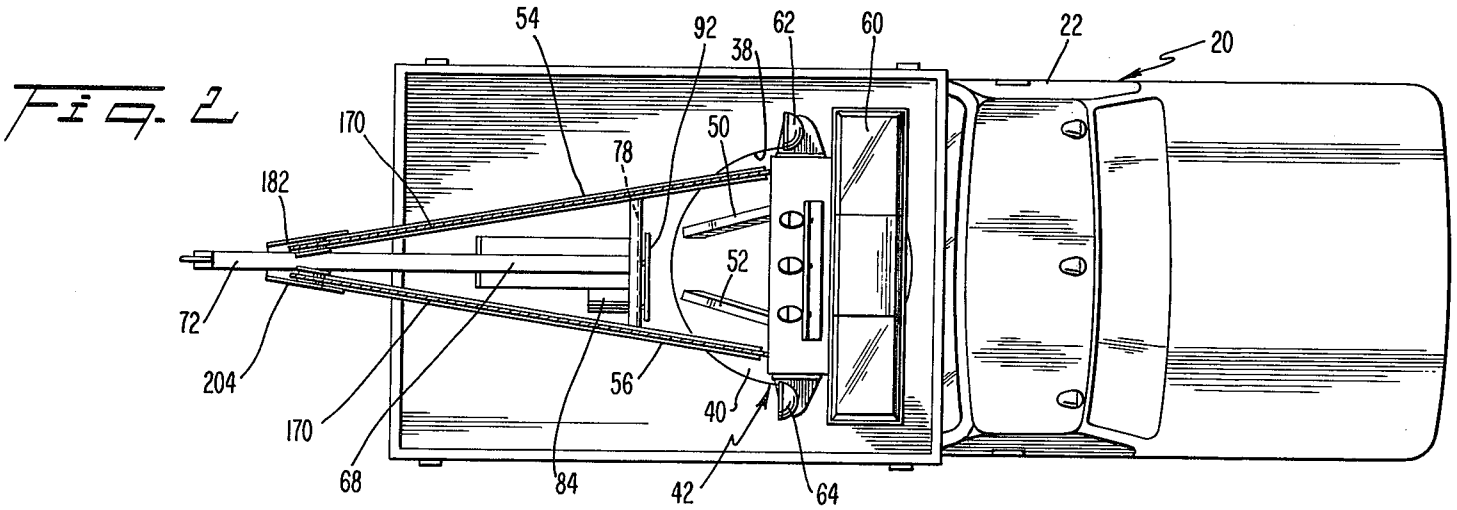
FIG. 2 is a top plan view of the towing vehicle of FIG. 1.
Figure 3:
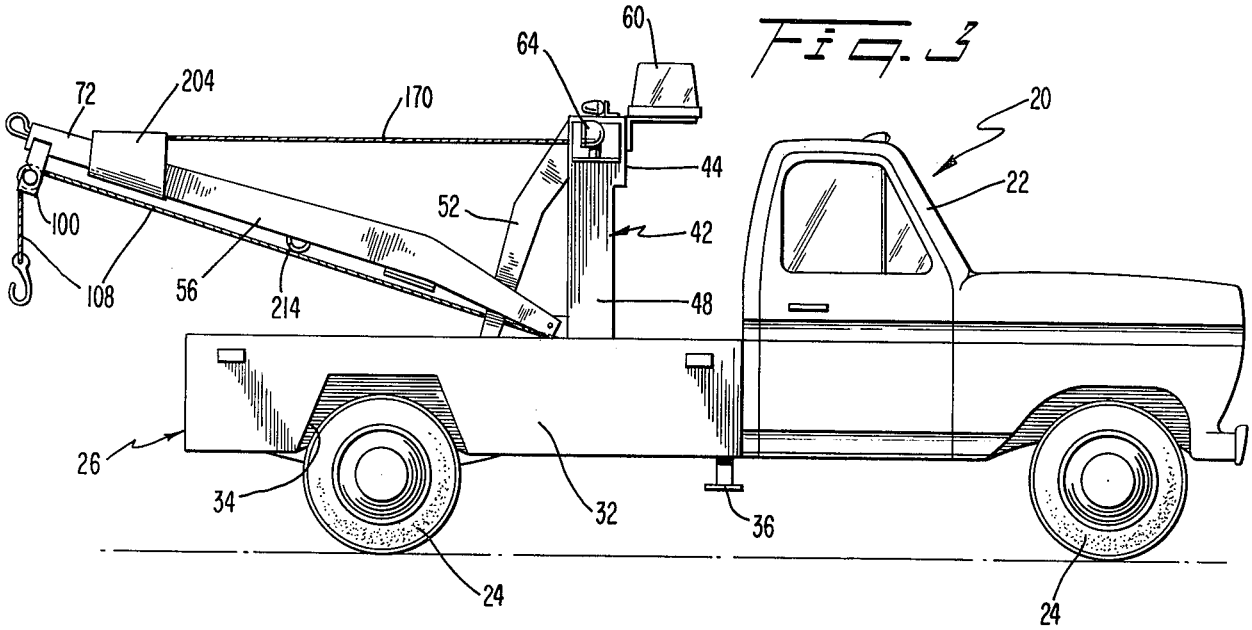
FIG. 3 is a side elevational view of the towing vehicle of FIG. 1.

The present invention is embodied in a towing vehicle 20 which, as shown in FIGS. 1–3, includes a cab 22 supported upon a frame having structural support members (not shown) supported upon a set of tires 24. Mounted upon the frame behind cab 22 is a hoist support bed assembly 26 having a generally flat, rectangular top surface 28, a rear wall 30, and left and right side walls 32. Each of the side walls contains a suitable cutout 34 to accommodate the rear tires 24 of the vehicle.

Preferably, the upper wall 28 together with rear wall 30 and side walls 32 form a generally rectangular, smooth walled assembly which compliments the overall styling of the vehicle and provides a neat, uncluttered appearance. Suitable outriggers 36 are attached to the vehicle frame and extend downwardly from the two front corners of the bed assembly 26. When the outriggers 36 are in their uppermost or fully retracted positions, they are almost entirely hidden behind side walls 32.

Figure 4:
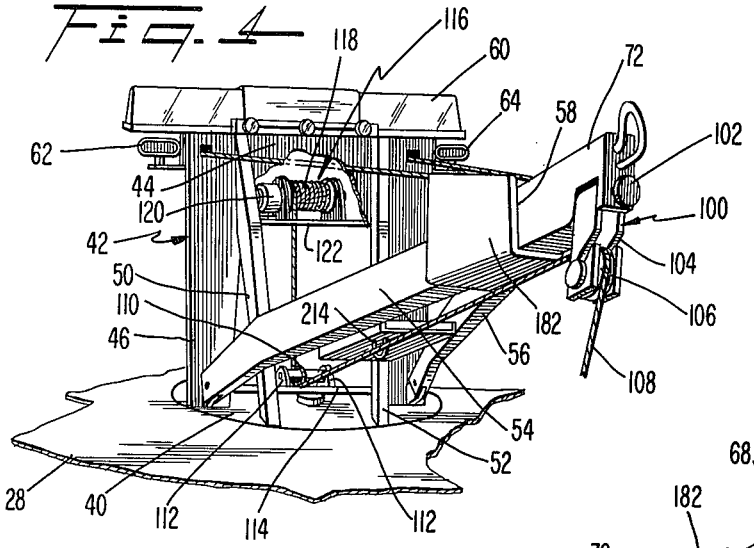
FIG. 4 is a partial perspective view, with parts broken away, of the rotating boom assembly of the towing vehicle of FIG. 1.
Figure 7:
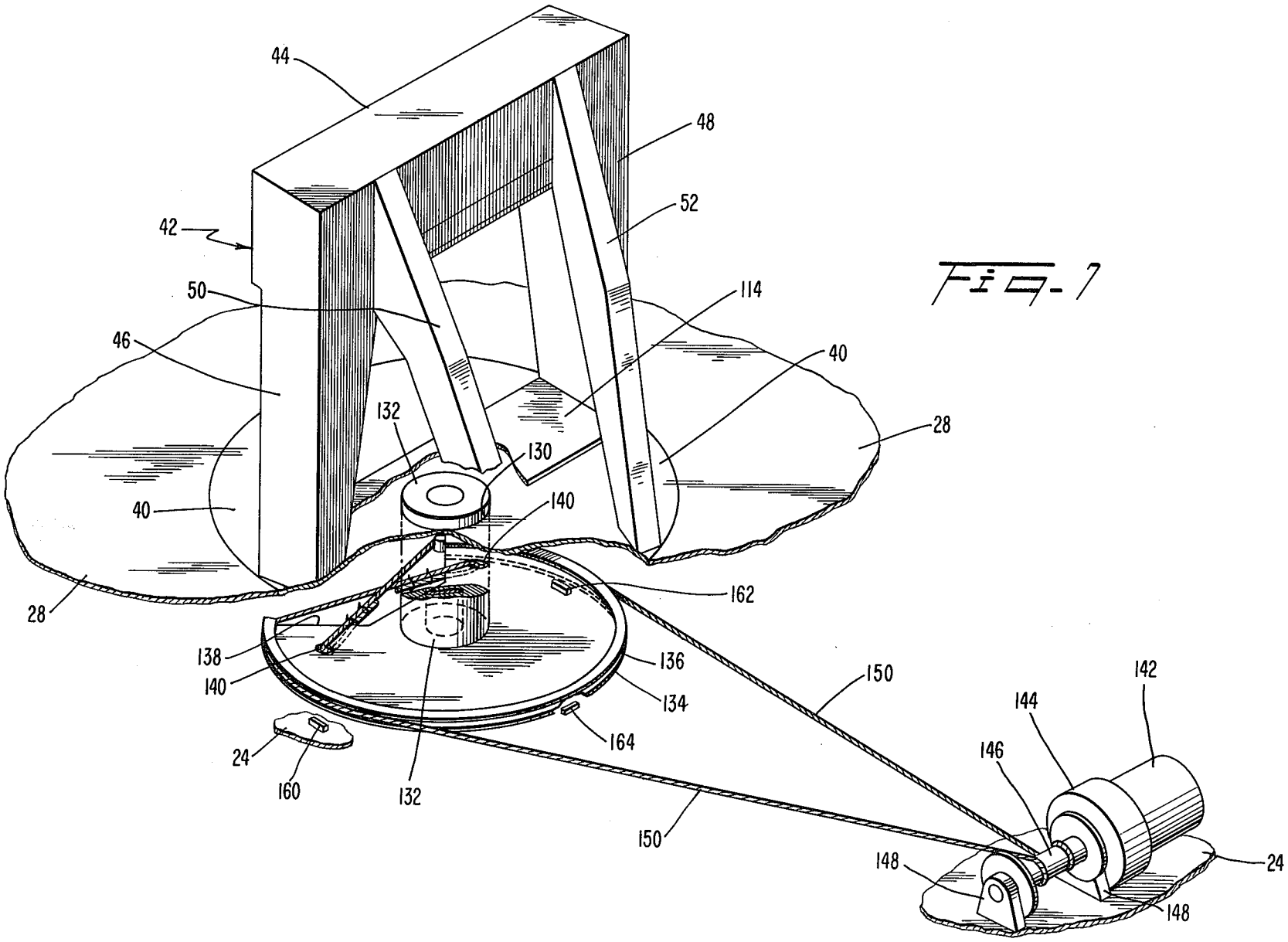
FIG. 7 is a partial perspective view, with parts broken away, of the boom assembly turntable and turntable drive mechanism of the towing vehicle of FIG. 1.

The top wall 28 of the bed defines a circular opening 38 for receiving a circular, flat plate 40 forming the base of a boom turntable according to the present invention. As shown in FIGS. 4 and 7, mounted atop the circular plate 40 is an inverted, generally U-shaped main support 42 which is hollow and is formed of a hollow horizontal member 44 which interconnects the upper ends of two vertical legs 46 and 48. The lower ends of legs 46 and 48 are suitably attached to plate 40, preferably by welding, so as to form a rigid integral support structure. A pair of additional support members 50 and 52, which are preferably hollow steel elements having a rectangular cross section, are welded or otherwise suitably attached between the upper shoulders of the U-shaped support and intermediate peripheral positions on plate 40.

An additional pair of support arms 54 and 56 are joined together at their distal ends to form an apex 58 and are pivotally journalled to support plate 40 adjacent the ends of each of the vertical legs 46 and 48 of the U-shaped main support. Preferably, arms 54 and 56 are steel members which are hollow and have a generally rectangular cross section for strength.

Mounted atop the U-shaped main support is a caution beacon assembly 60 and a pair of night working lights 62 and 64. Preferably, the lights 62 and 64 are mounted one each on either side of the U-shaped main support with their illumination beams generally directed toward the end of the boom assembly.

Figure 5:
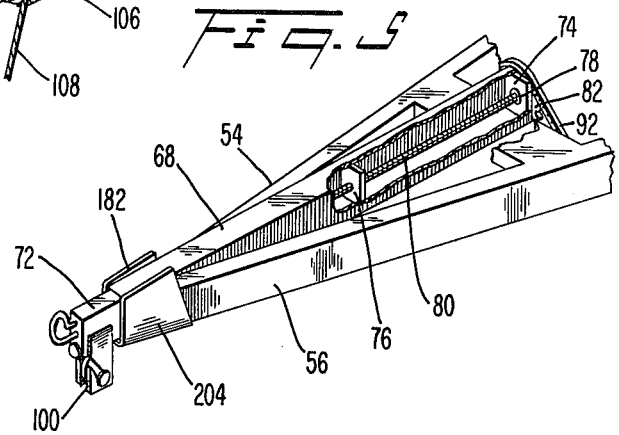
FIG. 5 is a partial perspective view, with parts broken away, of the telescoping boom of the towing vehicle of FIG. 1.
Figure 6:
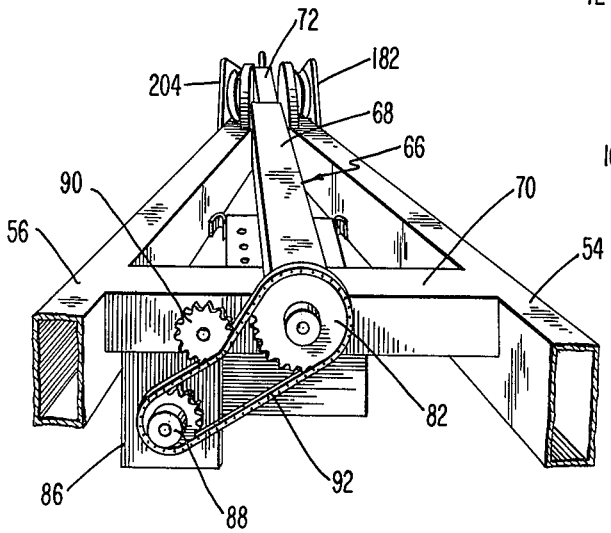
FIG. 6 is a partial perspective view showing the drive assembly of the telescoping boom of FIG. 5.

Mounted to the V-shaped support frame comprised of elements 54 and 56 is a telescoping boom 66 illustrated best in FIGS. 5 and 6. The telescoping boom includes an outer support sleeve 68 of generally rectangular cross section which is fixedly attached to the V-shaped support frame, by any suitable means such as welding, at apex 58. The other end of sleeve 68 is welded or otherwise fixedly attached to the midpoint of a cross support bar 70 which is laterally connected between the approximate midpoint of arms 54 and 56. A second hollow metal sleeve 72 has a cross section similar to the inner configuration of sleeve 68 and is slidably received therein. Both the outer and inner sleeves 68 and 72 include end walls 74 and 76, respectively. End wall 74 of outer sleeve 68 includes a suitable bearing 78 supporting a screw 80 for free rotation within sleeve 68. The screw 80 is supported by bearing 78 so that it is free to rotate but is constrained against axial movement into or out of sleeve 68. Screw 80 is received within a threaded opening in end wall 76 of the inner member 72, and a gear wheel 82 is keyed to the screw 80 so as to impart rotary movement thereto. Thus, as gear 82 is rotated, screw 80 is turned causing the inner sleeve 72 of the telescoping boom to move into or out of the outer sleeve 68, depending upon the direction of rotation of screw 80.

Figure 11:
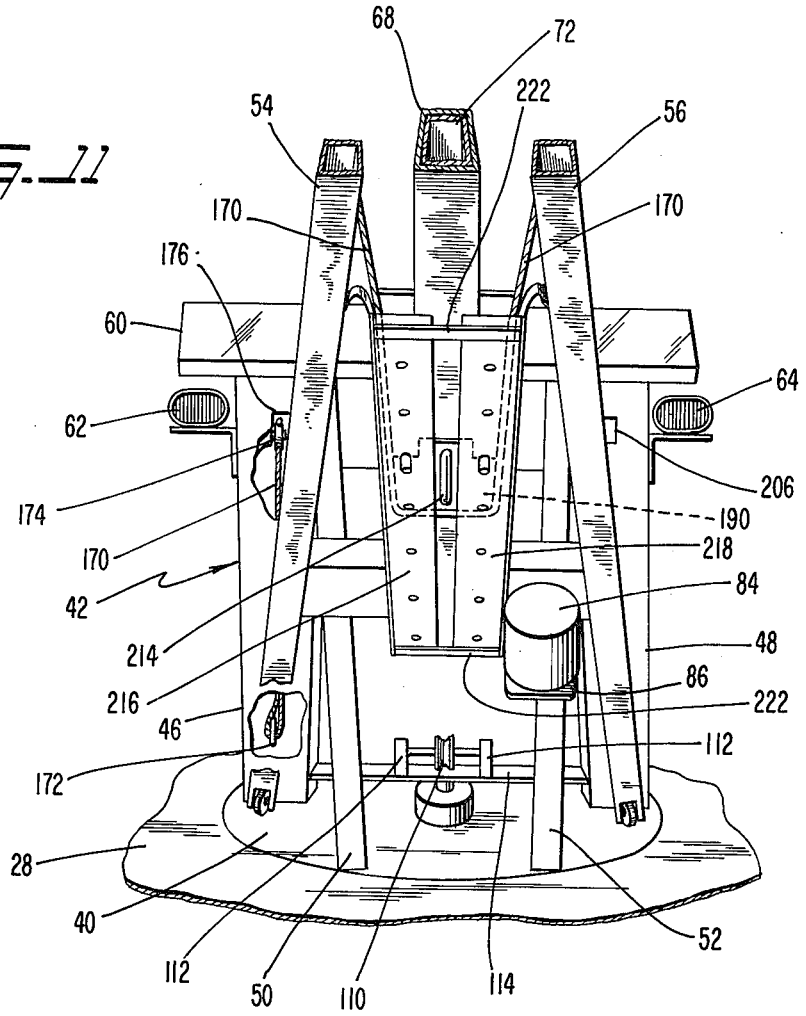
FIG. 11 is a partial perspective view showing the underside of the adjusting assembly of FIG. 8.

A reversible electric drive motor 84 (FIG. 11) is mounted on a support bracket 86 and has a small sprocket gear 88 attached to its output shaft. An idler sprocket 90 is rotatably attached to cross support member 70 and a chain 92 is mounted so as to couple rotary motion of motor 84 to screw 80 by means of sprockets 88 and 82.

Mounted on the extreme distal end of inner boom member 72 is a pulley support 100 which is pivotable about a pin 102 disposed longitudinally in member 72. A pair of slots 104 enable the easy installation and removal of a freely rotatable cable pulley wheel 106 over which the main hoisting cable 108 is constrained. Cable 108 passes over pulley 106 and then is directed along the under-surface of the V-shaped support frame formed of members 54 and 56, and then passes under a second cable pulley 110 which is journalled for rotation in a pair of ears 112 which are fixedly attached to the top surface of a generally flat support shelf 114. Shelf 114 is suitably attached, as by welding, between vertical legs 46 and 48 of the U-shaped main support 42 and is preferably disposed approximately four inches above the top surface of plate 40.

After the cable passes under pulley 110, it then proceeds upwardly to an electric cable winch 116 having a cable supply drum 118 rotatably driven through appropriate intermediate gears by a reversible electric motor 120. The electric cable winch assembly 116 is preferably fixedly attached to the bottom wall 122 of the hollow horizontal member 44 of the U-shaped main support 42. It is important to note, at this point, that by directing the main hoist cable 108 over pulley 106, along the under-surface of the boom to pulley 110, and then upwardly to the winch assembly 116, considerable safety is provided in the event that the cable snaps while under load. In conventional towing vehicles, for instance, where the towing cable is directed over the top of the boom assembly and then down to a winch, if the cable snaps, the violent reaction which results causes the end of the cable to snap forward over the top of the vehicle cab whereupon it can cause considerable damage to persons in the immediate area of the vehicle as well as to the vehicle itself. The present invention, however, avoids this problem simply and effectively. In the event that cable 108 should break while under tension, the reaction will cause the cable to snap back toward pulley 110. At this point, all of the damaging forces will be dissipated by the turntable plate 40 and the various boom support structures which have the inherent strength to withstand such reactive forces.

Referring to FIG. 7, the turntable plate 40 defines a hole 130 in the center thereof for receiving the upper end of a cylindrical, hollow main shaft 132. Preferably, main shaft 132 is six inches in diameter and approximately sixteen inches in length and protrudes three inches above the upper surface of plate 40. The shaft is heavy guage steel and is welded rigidly to plate 40 for support. Under plate 40, shaft 132 is machine fit to be received within an appropriate support frame (not shown) which may be of any suitable configuration. While roller bearings, support wheels, and several other types of mountings may be provided, particularly satisfactory results can be achieved by merely assembling the structure to be machine fit within an appropriate opening in the frame. Of course, all sliding surfaces will be provided with grease fittings and lubrication to reduce friction.

Attached to the lower end of shaft 132 is a bull wheel 134 having an outwardly directed peripheral flange 136. The bull wheel is welded or otherwise fixedly attached to shaft 132 such that rotation of the bull wheel will impart rotation to the turntable plate 40. A radial notch 138 is cut into the bull wheel over an arc of approximately 90°, and a pair of cable receiving openings 140 are provided on each side of this notch. Securely attached to the vehicle frame 24 at the rear end of the vehicle under wall 28, is a reversible electric motor 142. Motor 142 is connected through a suitable gear box 144 to a shaft 146 which is journalled for rotation in ears 148 attached to the frame. A length of cable 150 is attached to one of the openings 140 in bull wheel 134 and then passes to the peripheral flange 136 at the opposite end of notch 138. From that point, the cable 150 proceeds around the bull wheel to shaft 146 of the motor 142. The cable is wrapped around shaft 146 to form approximately two turns and is then returned to the bull wheel where it is attached to the opposite opening 140.

As the motor 142 is energized to rotate in either direction, the resulting rotation of shaft 146 is coupled by cable 150 to the bull wheel 134. Rotation of the bull wheel, in turn, is transmitted by main shaft 132 to the turntable plate 40. As a result, the entire boom assembly carried upon turntable 40 may be rotated in either direction about the vertical axis of shaft 132.

In order to prevent the rotating boom assembly from rotating more than 90° to either side of the center line of the vehicle, a pair of magnetic boom position switches 160 and 162 are fixedly attached to the vehicle frame 24 adjacent the lower perimeter of the bull wheel 134. These switches are disposed at diametrically opposing positions on either side of the axis of rotation of the bull wheel and are within magnetic proximity of a permanent magnet 164 carried by the bull wheel 134. Magnet 164 is disposed directly underneath the rearwardly extending boom portions so that when the boom has rotated 90° to either side of the logitudinal center line, the magnet 164 will be in proximity of either switch 160 or switch 162. These switches are connected by circuitry to be described below for disabling continued operation of motor 142 whenever the limit position has been reached. In this manner, the boom assembly of the present invention is permitted to travel through a full 180° arc, but is precluded from travel beyond these extreme limits.

Turning now to FIGS. 8-11, the V-shaped support frame comprising frame members 54 and 56 is pivotally attached to turntable plate 40, as described above, and is supported in any one of a number preselected angular positions by a support cable 170 which extends between the apex 58 and the upper end of U-shaped main support 42. Cable 170 is fixed in overall length and runs from an eyelet 172 or other suitable point of attachment within the vertical leg 46 of main support 42, upwardly through the vertical leg 46 and over the top of a small pulley 174. A small opening 176 in the rear wall of support 42 permits the cable 170 to pass outwardly from the support toward apex 58.

Cable 170 then passes around a pulley wheel 178 journalled between an upstanding tab 180 mounted on the end of support member 54 and a generally trapezoidal side plate 182 welded to the side of the support member as shown in FIG. 8. The cable then passes over a second pulley (not shown) disposed directly underneath pulley 178, and then passes through the interior of support arm 54 past an inwardly curved side wall portion 184 and guide pin 186 through an opening 188 in the inner side wall. The cable then passes around a slider 190 which is slideably received in a carriage 192 attached to the V-shaped support frame. Thereafter, the cable traverses a mirror image path past curved wall portion 194 and pin 196, around pulleys 198 and 200, which are constrained between a tab 202 and a second generally trapezoidal side plate 204, and then back through opening 206 in the rear wall of main support 42 opposite opening 176. The cable then passes over a pulley identical to pulley 174 and is fixedly attached to an eyelet identical to eyelet 172.

Slider 190 is formed from a generally flat plate having a somewhat curved rear side edge 208 which has a groove formed therein for receiving cable 170. The front of the slider includes a tongue 210 having two shoulders one on each side thereof. Attached to the bottom surface of slider 190 is a generally rectangular runner 212 having an eyelet 214 securely attached thereto for selective engagement by the main hoisting cable hook for assisting in repositioning the slider and adjusting the boom angle.

Carriage assembly 192 includes a pair of generally flat, rectangular plates 216 and 218 which are disposed in spaced relationship so as to define therebetween a channel 220 (FIG. 10). A pair of transverse support straps 222 secure the two plates 216 and 218 together and maintain the proper spaced relationship therebetween.

A pair of upright side walls 224 and 226 are attached adjacent their lower edges to plates 216 and 218. Similarly, a pair of top wall members 228 and 230 interconnect the upper edges of side plates 224 and 226, respectively, with respective sides of the outer sleeve 68 of the telescoping boom. As can be appreciated from FIGS. 9 and 10, the bottom wall of the telescoping boom sleeve 68 cooperates with flat plates 216 and 218 to constrain the slider 190 therebetween. It can also be appreciated that the carriage assembly 192 is in the form of a generally rectangular, hollow assembly in which the slider 190 is free to slide toward and away from the distal end of the boom. A rectangular plate 232 is welded to the back end of the carriage assembly to close the same, and a pair of U-shaped mounting elements 234 and 236 attach the outer or distal end of the carriage to the support members 54 and 56, respectively.

A series of holes 238 and 240 are provided in each of the flat plates 216 and 218, respectively, with the holes of each plate in lateral correspondence. In similar fashion, a series of holes 242 and 244 are provided in top plates 228 and 230, respectively, with the upper holes in superposition with the lower holes as shown.

A pair of stop pins 246 and 248 are adapted to be received within the holes, as shown in FIGS. 8 and 9, and cooperate with the shoulders on either side of tongue 210 of slider 190 to provide a positive stop or outer limit therefore. In this manner, the slider 190 may be moved inwardly or outwardly in carriage assembly 192 thereby to take up more or less of cable 170 and, thus, determine the angular position of the boom. Once the desired angular position has been achieved, then pins 246 and 248 may be dropped into place, preventing the slider 190 from moving beyond the desired position.

Figure 12:
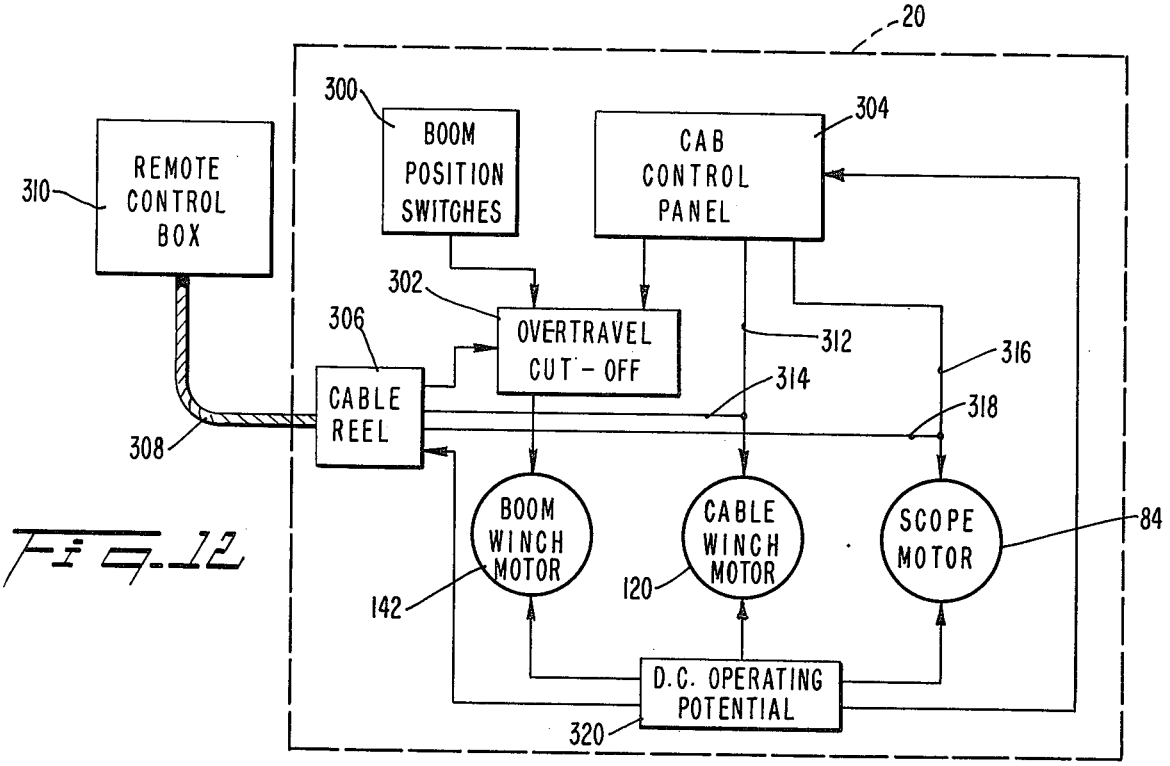
FIG. 12 is a schematic block diagram of the control system according to the present invention.

FIG. 12 illustrates in block diagram form, the electrical control system of the present invention. Mounted on the vehicle 20 are the boom position switches made up of elements 160, 162 and 164 (FIG. 7). These boom position switches, schematically identified as block 300, are connected through an overtravel cutoff circuit 302 to the boom winch motor 142. The overtravel cutoff network 302 also receives control signals from a manually operable switch on a control panel 304 mounted in the cab of the vehicle, preferably near or as an integral part of the vehicle dashboard. The overtravel cutoff network 302 also receives an input from a self-reeling cable reel 306 having a cable 308 which extends to a remote control switch box 310. Remote control box 310 generally contains the same controls as are provided on the cab control panel 304 so that one acts as a backup for the other.

The overtravel cutoff network 302 may be of any suitable design. For example, it may include a simple relay network activated in response to a signal from the boom position switches 300 to disconnect the input signals from both the cab control panel and the remote control box from the motor 142. Whenever the boom position switches indicate that the boom is moving within its permitted path, the cab and remote control switches will be directly connected to motor 142 facilitating direct control thereby.

Both the cab control panel 304 and the remote control box 310 contain additional switches enabling the selective supply of operating potential to the cable winch motor 120 and the telescope winch motor 84 over lines 312–314 and 316–318, respectively.

Preferably, both of the control panels will contain six manually operated switches arranged in three pairs. Each pair will control one of the three motors 142, 120 and 84, and within each pair one switch will be connected to cause motor operation in the counterclockwise direction while the other causes rotation in the clockwise direction. In this manner, all three primary functions of the towing vehicle can be controlled from either inside the vehicle cab or, by use of the remote control switch box 310, from any desired remote position. By providing a convenient length of cable 308 on the cable reel 306, the operator can extend the remote control box 310 from the vehicle while at the same time taking the main cable hook along with him for performing a hoisting or towing operation. Since the control box will be directly at his hand, while he is at the same time monitoring or observing the hoisting operation, and since the single operator can control all hoisting functions, an extremely high degree of flexibility is provided while at the same time maintaining excellent safety. Of course, all of the motors are operated from a suitable source of DC operating potential 320, such as a storage battery, with appropriate connections to control boxes 310 and 304 to enable forward or reverse operation of the motors, as desired.

Inasmuch as the foregoing preferred embodiment is subject to many variations, alterations and changes in detail, it is intended that the foregoing description and the attached drawings be interpreted as illustrative and not in a limiting sense.

What is claimed is:

1. A towing vehicle having a frame, and a drive train for propulsion of the vehicle along a roadway, comprising:

a turntable mounted on said frame for rotation about a vertical axis;

first means for selectively rotating said turntable about said vertical axis in either direction;

a boom assembly attached to said turntable for rotation therewith about said vertical axis, said boom assembly including an inverted, generally U-shaped main support having a horizontal member connecting the upper ends of two vertical legs fixedly attached at their lower ends to said turntable, said boom assembly further including a generally V-shaped support frame having first and second arms joined together at one end to form an apex and each pivotally attached at the other end to said turntable adjacent a respective vertical leg of said U-shaped main support for pivotal movement about a horizontal axis, said V-shaped support frame including a support cable between the upper end of said U-shaped main support and the apex of said V-shaped support frame to maintain said V-shaped support frame in a preselected angular position relative to said U-shaped main frame and said turntable;

a telescoping boom mounted to said V-shaped support frame;

a second means on said V-shaped support frame for selectively extending and retracting said telescoping boom;

a cable winch;

and a cable pulley disposed on the distal end of said telescoping boom, said pulley being rotatable about a horizontal axis parallel to said horizontal axis of rotation of said V-shaped frame, the cable from said winch passing along the underside of said V-shaped frame, and over said pulley;

said first and second means and said winch being operable independently of the vehicle drive train;

control means coupled to said first and second means and said winch for controlling said rotatable turntable, said telescoping boom and said cable winch from positions remote from said vehicle, and support cable adjustment means on said V-shaped support frame for adjusting the angular position of said V-shaped support frame with respect to said U-shaped main support, said adjustment means comprising a carriage attached to said V-shaped support frame, a slider disposed on said carriage for movement toward and away from said apex, a pair of pulleys on the distal end of said V-shaped support frame, and means cooperating with said carriage for maintaining said slider in a preselected position, said support cable being attached at one end to said U-shaped main support, passing around one of said pulleys, around said slider, around the other of said pulleys, and back to said U-shaped main support where it is attached at its other end, whereby movement of said slider results in lengthening or shortening of the cable between the distal end of said V-shaped support frame and said U-shaped main support thereby to adjust the angle therebetween.

2. A towing vehicle according to claim 1, wherein said turntable comprises a flat circular plate defining a hole in the center thereof, and a hollow, cylindrical support shaft protruding partially through said hole and welded rigidly to said plate.

3. A towing vehicle according to claim 2 wherein said turntable further comprises a bull wheel fixedly attached to the lower end of said cylindrical support shaft; and wherein said first means comprises a reversible electric motor, a cable shaft coupled to said motor for rotation thereby, and a length of cable passing around said bull wheel and said shaft to transmit rotation of said cable shaft to said turntable.

4. A towing vehicle according to claim 1 further including at least one limit switch coupled to said control means and mounted on said vehicle, said switch being responsive to rotation of said turntable to a predetermined extreme position to disable said first means whereby said turntable is prevented from causing damage by overtravel.

5. A towing vehicle according to claim 1 further including a working light fixedly mounted on said boom assembly to direct light toward the distal end of said telescoping boom regardless of the rotational position of said boom assembly with respect to the vehicle.

6. A towing vehicle according to claim 5 further including a second working light and a warning beacon mounted on said boom assembly.

7. A towing vehicle according to claim 1 wherein said slider includes an eyelet engageable by the end of the winch cable for movement of the slider.

8. A towing vehicle according to claim 1 wherein said slider defines a cable receiving groove in a side wall thereof.

9. A towing vehicle according to claim 1 wherein said U-shaped main support is hollow and defines an opening in each upper corner of a wall thereof facing said V-shaped support frame; and wherein a pulley is mounted behind each said opening, each end of said support cable passing through one of said openings; around said pulley and being attached to the interior of said U-shaped main support.

10. A towing vehicle according to claim 1 wherein said carriage comprises first and second flat, rectangular plates defining therebetween a channel for said slider, each of said plates further defining a series of holes in lateral correspondence; and wherein said slider position maintaining means comprises a pair of pins received in laterally adjacent holes in said carriage plates to act as stops for said slider.

11. A towing vehicle according to claim 10 wherein said carriage further comprises upright side walls attached to said plates, and a top wall attached to said side walls to define a generally rectangular, hollow assembly, said top wall defining a plurality of holes in superposition with the holes in said plates, each of said stop pins being received in both said top wall and one of said plates to block the path of movement of said slider.

12. A towing vehicle according to claim 11 wherein said top wall of said carriage comprises a pair of rectangular metal sheets and a portion of the bottom of said telescoping boom, said sheets being welded to said telescoping boom and said upright side walls; and wherein said slider is retained in said channel by said bottom wall of said telescoping boom and said carriage plates.

13. A towing vehicle according to claim 1 wherein said telescoping boom comprises a pair of hollow members, one slidably received within the other and each having at least one end wall, a screw journalled for rotation in the end wall of the outer hollow member and disposed in fixed axial position within said member, and the end wall of the inner hollow member having a threaded opening for receiving said screw whereby rotation of said screw causes said inner member to extend or retract with respect to said outer member, said outer member being attached to said V-shaped support frame.

14. A towing vehicle according to claim 13 wherein said second means comprises a reversible electric motor and means coupling rotation of said motor to said screw.

15. A towing vehicle according to claim 1 wherein said first and second means comprise first and second electrical means respectively and said cable winch comprises an electrical cable winch and said control means comprises a control box electrically coupled to said first and second electrical means and said electric winch by an electrical cable, and a self-reeling cable reel on the vehicle for said electric cable.

16. A towing vehicle according to claim 15 wherein said control means further includes a second control box mounted in the vehicle cab and electrically coupled to said first and second electrical means and said electric winch.

17. A towing vehicle according to claim 1 wherein said U-shaped main support is hollow; and wherein said electric cable winch is disposed within the horizontal upper member of said U-shaped main support.

18. In a towing vehicle having a generally upright main support and a horizontally pivotable boom, a boom adjustment assembly comprising:

a carriage on said boom;

a slider disposed on said boom for movement toward and away from the distal end thereof;

a pair of pulleys on the distal end of said boom;

means cooperating with said carriage for maintaining said slider in a preselected position;

a support cable attached at one end to said main support, passing around one of said pulleys, around said slider, around the other of said pulleys, and back to said main support where it is attached at its other end, whereby movement of said slider results in lengthening or shortening of the cable between the distal end of said boom and said main support thereby to adjust the angle therebetween, and said carriage comprises first and second flat, rectangular plates defining therebetween a channel for said slider, each of said plates further defining a series of holes in lateral correspondence and wherein said slider position maintaining means comprises a pair of pins received in laterally adjacent holes in said carriage plates to act as stops for said slider.

19. The assembly as recited in claim 18 wherein said carriage further comprises upright side walls attached to said plates, and a top wall attached to said side walls to define a generally rectangular, hollow assembly, said top wall defining a plurality of holes in superposition with the holes in said plates, each of said stop pins being received in both said top wall and one of said plates to block the path of movement of said slider.

20. A towing vehicle having a frame, and a drive train for propulsion of the vehicle along a roadway, comprising:

a turntable mounted on said frame for rotation about a vertical axis;

first electrical means for selectively rotating said turntable about said vertical axis in either direction;

a boom assembly attached to said turntable for rotation thereon about said vertical axis, said boom assembly including an inverted, generally U-shaped main support having a horizontal member connecting the upper ends of two vertical legs fixedly attached at their lower ends to said turntable, said boom assembly further including a generally V-shaped support frame having first and second arms joined together at one end to form an apex and each pivotally attached at the other end to said turntable adjacent a respective vertical leg of said U-shaped main support for pivotal movement about a horizontal axis, said V-shaped support frame including a support cable between the upper end of said U-shaped main support and the apex of said V-shaped support frame to maintain said V-shaped support frame in a preselected angular position relative to said U-shaped main frame and said turntable;

a telescoping boom mounted to said V-shaped support frame;

second electrical means on said V-shaped support frame for selectively extending and retracting said telescoping boom;

an electric cable winch mounted on said horizontal member of said U-shaped main support;

a first cable pulley disposed on said turntable under said cable winch and a second cable pulley disposed on the distal end of said telescoping boom, said first and second pulleys being rotatable about horizontal axes parallel to said horizontal axis of rotation of said V-shaped frame, the cable from said winch passing downwardly from said winch, under said first pulley, along the underside of said V-shaped frame, and over said second pulley;

said first and second electrical means and said electric winch being operable independently of the vehicle drive train; and control means electrically coupled to said first and second electrical means and said electric winch for controlling said rotatable turntable, said telescoping boom and said cable winch from positions remote from said vehicle;

said turntable comprising a flat circular plate defining a hole in the center thereof, and a hollow, cylindrical support shaft protruding partially through said hole and welded rigidly to said plate;

said turntable further comprising a bull wheel fixedly attached to the lower end of said cylindrical support shaft; and wherein said first electrical means comprises a reversible electric motor, a cable shaft coupled to said motor for rotation thereby, and a length of cable passing around said bull wheel and said shaft to transmit rotation of said cable shaft to said turntable;

support cable adjustment means on said V-shaped support frame for adjusting the angular position of said V-shaped support frame with respect to said U-shaped main support, said adjustment means comprising a carriage attached to said V-shaped support frame, a slider disposed on said carriage for movement toward and away from said apex, a pair of pulleys on the distal end of said V-shaped support frame, and means cooperating with said carriage for maintaining said slider in a preselected position, said support cable being attached at one end to said U-shaped main support, passing around one of said pulleys, around said slider, around the other of said pulleys, and back to said U-shaped main support where it is attached at its other end, whereby movement of said slider results in lengthening or shortening of the cable between the distal end of said V-shaped support frame and said U-shaped main support thereby to adjust the angle therebetween;

said telescoping boom comprising a pair of hollow members, one slidably received within the other and each having at least one end wall, a screw journalled for rotation in the end wall of the outer hollow member and disposed in fixed axial position within said member, and the end wall of the inner hollow member having a threaded opening for receiving said screw whereby rotation of said screw causes said inner member to extend or retract with respect to said outer member, said outer member being attached to said V-shaped support frame.

21. A towing vehicle according to claim 1 wherein;

said first and second means comprise first and second electrical means and said cable winch comprises an electrical cable winch; and wherein said electrical cable winch is mounted on said horizontal member of said U-shaped main support;

a further cable pulley disposed on said turntable under said cable winch and rotatable about a horizontal axis parallel to said horizontal axis of rotation of said V-shaped frame, the cable from said winch passing downwardly from said winch, under said further pulley, along the underside of said V-shaped frame, and over said pulley; and said control means are electrically coupled to said first and second electrical means and said electric winch for controlling said rotatable turntable, said telescoping boom and said cable winch from positions remote from said vehicle.

* * * * *